United States Patent [19]

Phillips et al.

[11] Patent Number: 4,676,016

[45] Date of Patent: Jun. 30, 1987

[54] HANGER FOR A WALL COVERING

[76] Inventors: Harold B. Phillips, 1 Villa, Apt. F, Mansfield, Mass. 02048; John Bubernak, 119 South St., Plainville, Mass. 02762

[21] Appl. No.: 795,871

[22] Filed: Nov. 7, 1985

[51] Int. Cl.[4] ..... G09F 7/22

[52] U.S. Cl. ..... 40/617; 160/383

[58] Field of Search ..... 40/13, 11 R, 617, 603; 24/455, 460, 462, 522, 546, 456, 459, 152, 518; 160/398, 327, 382, 383, 380, 395

[56] References Cited

U.S. PATENT DOCUMENTS

| | | | |
|---|---|---|---|
| 17,413 | 6/1857 | Bates | 24/518 |
| 21,703 | 10/1858 | Shaler | 40/11 R |
| 3,099,058 | 7/1963 | Pettingell | 24/152 |
| 4,403,642 | 9/1983 | Morris | 160/328 |
| 4,549,334 | 10/1985 | Miller | 24/456 |
| 4,566,236 | 1/1986 | Pound | 52/222 |
| 4,578,136 | 3/1986 | Brown | 40/2 R |

FOREIGN PATENT DOCUMENTS

| | | | |
|---|---|---|---|
| 1101751 | 5/1981 | Canada | 40/11 R |
| 1474152 | 3/1967 | France | 40/11 R |
| 2039982 | 8/1980 | United Kingdom | 160/383 |

*Primary Examiner*—Robert Peshock
*Assistant Examiner*—Cary E. Stone
*Attorney, Agent, or Firm*—Robert T. Gammons

[57] ABSTRACT

A hanger for a flexible wall covering in the form of an elongate flexible strip adapted to be attached to a wall adjacent the ceiling, provided with elastically interengageable jaws normally standing apart to admit an edge of the wall covering and thereafter interengageable to anchor the wall covering suspended therefrom in contact with the wall.

7 Claims, 7 Drawing Figures

HANGER FOR A WALL COVERING

BACKGROUND OF THE INVENTION

Hangers for supporting fabric wall coverings are shown in U.S. Pat. Nos. 1,171,952; 3,833,046; 4,018,260; and 4,053,008. While the wall hangers shown in these patents are effective for holding a flexible panel suspended against a wall, once the panel is properly engaged therewith, because of the structure embodied therein and the closeness of the hanger to the adjacent ceiling, considerable difficulty is experienced in engaging the edge of the flexible panel with the hanger. Generally, a tool is required to expand the clamping edges to receive the edge of the panel and this requires threading the edges through the length of the hanger. This problem is especially aggravated by the fact that the resiliently engaged jaws can only be expanded in successive lengths to introduce the edge of the panel. The problem of mounting is further aggravated by the proximity of the clamping means to the ceiling which affords limited access for manipulation. It is the purpose of this invention to provide a wall hanger which will obviate the aforesaid disadvantages in a simple and expeditious manner so that the edge of the panel to be hung can be easily interengaged with the jaws of the hanger and clamped into place throughout its length without the aid of tools.

As herein illustrated, the hanger for wall coverings comprises a flat, elongate strip of generally rectangular configuration having spaced, parallel, longitudinal edges and flat front and back faces and resiliently interengageable jaws on the front face comprising a ledge projecting forwardly from the front face intermediate the longitudinal edges coextensive in lenght with the strip defining an upstanding lip spaced from and parallel to the front face and a latch coextensive in length with the lip resiliently supported on the face of the strip spaced from the lip by an amount to permit inserting the free edge of the wall covering to be supported between it and the lip, said latch being engageable with the lip to form the edge of the wall covering into a bite about the lip to thus anchor the edge of the wall covering to the hanger. The ledge projects forwardly from the front face of the strip at right angles thereto and the lip stands upwardly from the distal edge of the ledge. The latch is disposed below the ledge with respect to the upper edge of the strip and comprises forwardly and upwardly-inclined portions and a hook structured to embrace the lip. When the hook is disengaged from the lip, it stands in spaced, parallel relation to the lip so that there is a gap defined between the lip and the hook for freely receiving the upper edge of the hanging panel. The latch is flexibly deformable after inserting the upper edge of the panel to engage the hook with the lip. The lip at the distal edge of the ledge may be disposed at right angles thereto or at an angle inclined toward the face of the strip. The hook desirably defines an acute angle.

The invention will now be described in greater detail with reference to the accompanying drawings wherein.

The hanger herein illustrated is structured to enable suspending a sheet of fabric in the form of a decorative panel on the face of a wall, for example, adjacent the ceiling, although it is to be understood that it can be used to attach the panel to the wall at a position spaced downwardly from the ceiling and, further, is adapted to be used to attach the edges at opposite sides of the panel and the lower edge of the panel to the wall. As illustrated, since the structure of these several purposes is identical, it will be described with reference to attaching the upper edge of the panel to the wall.

Figure 1:
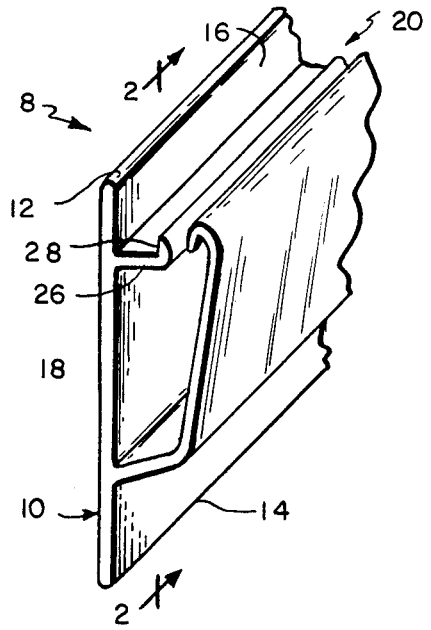
FIG. 1 is a fragmentary perspective of the wall hanger.

Referring specifically to the drawings, FIG. 1 shows the front face of a hanger 8 which is in the form of a flat, elongate strip 10 of generally rectangular configuration having spaced, parallel edges 12 and 14, a flat front face 16, a flat back face 18 and interengageable jaws 20 mounted to the front face 16. The structure is comprised of a flexible material so that it can be mounted to the surface of a wall generally indicated at 22 adjacent the ceiling indicated at 24. The structure may be adhesively attached to the wall or mechanically attached thereto by suitable fasteners inserted through the strip into the wall.

Figure 6:
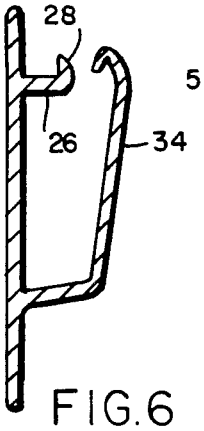
FIG. 6 shows a section like FIG. 2 wherein the lip is inclined.

The interengageable jaws 20 comprise a ledge 26 projecting forwardly from the front face 16 intermediate the opposite edges 12 and 14 at right angles thereto, at the forward extremity of which there is an upstanding lip 28. The lip 28 may be at right angles to the ledge 26 or may be inclined rearwardly toward the strip 10, FIG. 6. The jaws further comprise a latch 30 supported on the surface 16 adjacent to, but below, the ledge 26 which comprises a forwardly and upwardly-extending part 32 and a forwardly and upwardly-extending part 34, the latter having at its upper end a hook 36 provided with a depending portion 38 which is engageable with the upstanding lip 28.

Figure 7:
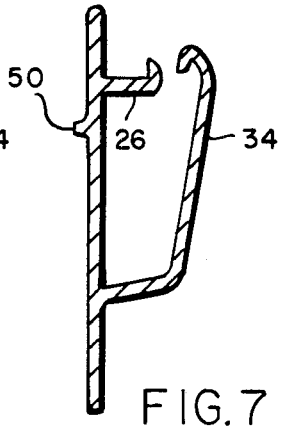
FIG. 7 shows a section like FIG. 2 wherein the strip is provided with a reinforcing rib.

A stiffening rib 50 may be provided longitudinally of the back face 18, FIG. 7.

Figure 2:
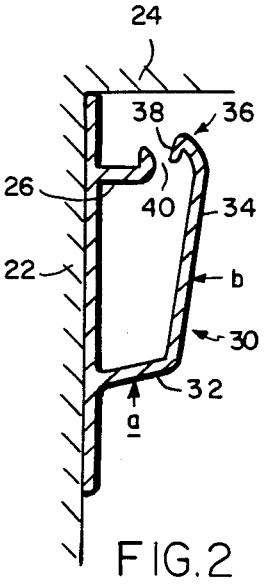
FIG. 2 is a vertical section of FIG. 1 taken on the line 2—2 with the jaws disengaged.
Figure 3:
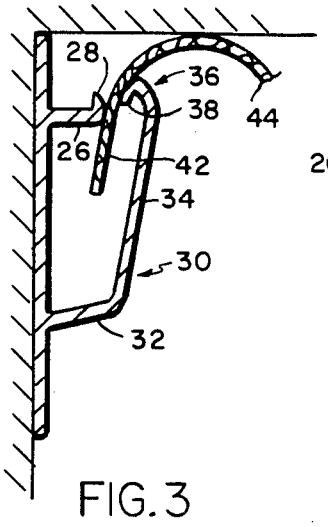
FIG. 3 is a view similar to FIG. 2 showing an edge of the wall covering disposed between the jaws.
Figure 5:
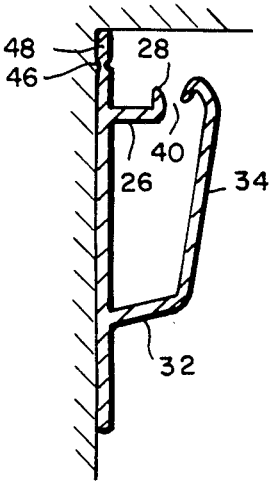
FIG. 5 shows a section like FIG. 2 with a detachable trim strip.

The structure is comprised of an elastic material and the parts 32 and 34 are disposed at an angle such that when the depending portion 38 is disengaged from the upstanding lip 28, there will be a gap 40, FIG. 2, between the same throughout the entire length of the structure of sufficient width so that the edge 42, FIG. 3, of a panel 44 which is to be suspended can be inserted through it between the upstanding lip 28 and the hook 36 as shown in FIG. 3 without having to use an implement to separate the hook from the ledge and/or without having to grasp the hook and pull it away. After the edge 42 of the panel 44 is introduced through the gap 40 between the upstanding lip and the hook 36, properly distributed throughout the length of the hanger and folded downwardly over the outer face of the part 34, the hook 36 of the latch is engaged over the lip 28 as shown in FIG. 5 to anchor the panel 44 to the hanger. Thus, it is possible to easily mount a wall hanging without the aid of tools and to suspend it uniformly without bias in one direction or another due to the inability of uniformly distributing the edge of the material between the initially clamped jaws as disclosed in the prior art which required forced separation to admit the edge.

While the hanger shown in the figures is illustrated attached to the wall adjacent the ceiling, it is within the scope of the invention to use hangers as thus structured for securing the vertical edges of a panel and/or the lower edge of a panel.

Desirably, the hanger is so dimensioned that when attached to the wall adjacent the ceiling, the panel to be suspended will be closely adjacent the ceiling. In order to provide for some adjustment, the strip 10 may be provided with an embossment 46 lengthwise thereof as shown in FIG. 5 which enables removing a portion 48 at the upper edge so that the structure can be placed closer to the ceiling. This removable strip is also desirable when the hangers are used along the sides or at the bottom so that the hanger is not visible beyond the edges of the panel which is secured to the wall.

Figure 4:
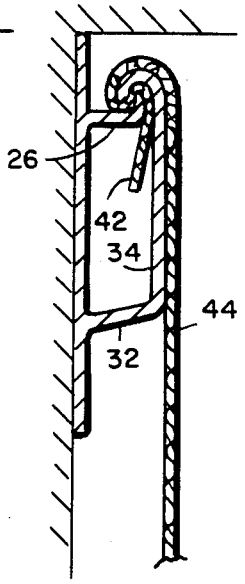
FIG. 4 is a view similar to FIG. 3 showing the jaws interengaged to anchor the fabric in place so that it is suspended therefrom.

The hanger is comprised of a flexible plastic extruded in the cross-sectional form disclosed in FIGS. 2, 3 and 4 so that the hook stands away from the lip when they are disengaged, but which permits engagement by pressure applied in the direction of the arrow a to the part 32 and pressure in the direction of the arrow b to the part 34 which, respectively, lift the hook upwardly with respect to the lip 28 and move it inwardly with respect thereto to interengage the hook with the lip.

It should be understood that the present disclosure is for the purposes of illustration only and includes all modifications or improvements which fall within the scope of the appended claims.

What is claimed is:

1. A hanger for attaching an edge of a flexible sheet material to a wall comprising an extrusion embodying a flat, elongate strip of generally rectangular configuration for engagement with the wall, said strip having spaced, parallel, longitudinal edges and flat front and back faces, upper and lower vertically-spaced, forwardly-projecting jaws at the front face of the strip, said upper jaw being relatively fixed and having an upstanding lip spaced from and parallel to said strip defining an upwardly-facing edge, said lower jaw extending forwardly and upwardly from said front face toward the upper jaw and having a downturned lip defining a downwardly-facing edge spaced forwardly and downwardly from the upwardly-facing edge of the upstanding lip, said lower jaw being elastically displaceable about an axis parallel to the upper jaw to dispose the downwardly-facing edge of the downwardly-extending lip behind the upwardly-facing edge of the upwardly-extending lip to anchor the free edge of a wall covering disposed about the upwardly-facing edge of the upper jaw between the jaws to thus support the sheet material in suspension.

2. A hanger according to claim 1 wherein the upper jaw projects forwardly from the front face of the strip at substantially right angles thereto and the lip stands upwardly from the forward edge of the jaw at right angles thereto.

3. A hanger according to claim 2 wherein the lips are structured to embrace each other.

4. A hanger according to claim 1 wherein the strip has along its upper longitudinal edge an embossed line of weakness which enables removing a portion of the strip of predetermined width from the upper edge of the strip.

5. A hanger according to claim 1 wherein the lip at the forward edge of the jaw is disposed at an angle to the jaw inclined toward the face of the strip.

6. A hanger according to claim 1 wherein the downwardly-extending lip is disposed at an acute angle to the upper jaw.

7. A hanger according to claim 1 wherein the lower jaw comprises a portion extending forwardly and upwardly from the face of the strip and a portion extending upwardly and away from the face of the strip such that the downwardly-facing edge of the lower jaw is spaced forwardly of the upwardly-facing edge of the upper jaw and wherein said lower jaw is elastically yieldable about spaced, parallel axes parallel to the face of the strip to dispose the downwardly-facing edge behind the upwardly-facing edge into interlocking engagement therewith.

* * * * *

US004676016B1

REEXAMINATION CERTIFICATE (2663rd)

United States Patent [19]

Phillips et al.

[11] B1 4,676,016

[45] Certificate Issued Sep. 5, 1995

[54] HANGER FOR A WALL COVERING

[76] Inventors: Harold B. Phillips, 1 Villa, Apt. F, Mansfield, Mass. 02048; John Bubernak, 119 South St., Plainville, Mass. 02762

Reexamination Request:
No. 90/003,238, Nov. 2, 1993

Reexamination Certificate for:

| | |
|---|---|
| Patent No.: | **4,676,016** |
| Issued: | **Jun. 30, 1987** |
| Appl. No.: | **795,871** |
| Filed: | **Nov. 7, 1985** |

[51] Int. Cl.[6] ..... G09F 7/22
[52] U.S. Cl. ..... 40/617; 160/383; D25/119; D25/124

[56] References Cited

U.S. PATENT DOCUMENTS

| | | |
|---|---|---|
| 444,832 | 1/1891 | Hartshorn . |
| 917,106 | 4/1909 | McGee . |
| 1,171,952 | 2/1916 | Higgin . |
| 1,758,720 | 5/1930 | Sodergren . |
| 2,325,500 | 7/1943 | Fosberg . |
| 2,335,361 | 11/1943 | Schiller . |
| 2,910,033 | 10/1959 | Weisburg . |
| 3,126,444 | 3/1964 | Taylor . |
| 3,214,314 | 10/1965 | Rowbottam . |
| 3,225,407 | 12/1965 | Daniels . |
| 3,379,237 | 4/1968 | Worthington . |
| 3,495,306 | 2/1970 | Eichberg . |
| 3,517,702 | 6/1970 | Mueller et al. . |
| 3,552,476 | 1/1971 | Le Tarte . |
| 3,682,163 | 8/1972 | Plummer . |
| 3,751,771 | 8/1973 | Vipond . |
| 3,786,171 | 1/1974 | Shira . |
| 3,833,046 | 9/1974 | Tombu . |
| 3,851,848 | 12/1974 | Wiele . |
| 4,018,260 | 4/1974 | Baslow . |
| 4,053,008 | 10/1977 | Baslow . |
| 4,089,075 | 5/1978 | May . |
| 4,197,686 | 4/1980 | Baslow . |
| 4,279,061 | 7/1981 | Santo . |
| 4,473,927 | 10/1984 | Miller . |
| 4,625,490 | 12/1986 | Baslow . |

FOREIGN PATENT DOCUMENTS

| | | |
|---|---|---|
| 2207954 | 8/1975 | Germany . |

*Primary Examiner*—Brian K. Green

[57] ABSTRACT

A hanger for a flexible wall covering in the form of an elongate flexible strip adapted to be attached to a wall adjacent the ceiling, provided with elastically interengageable jaws normally standing apart to admit an edge of the wall covering and thereafter interengageable to anchor the wall covering suspended therefrom in contact with the wall.

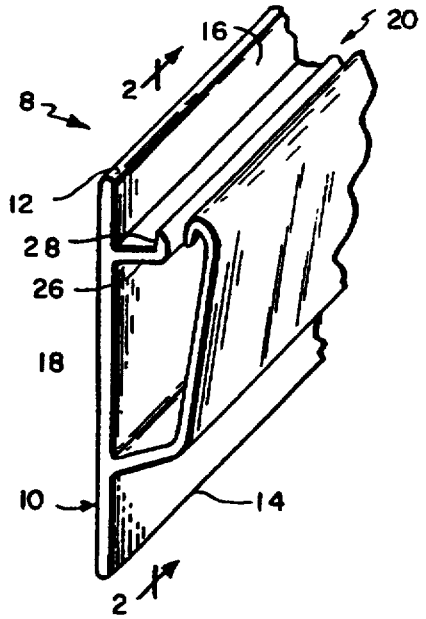

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 4 and 5 is confirmed.

Claims 1–3, 6, and 7 are cancelled.

New claims 8–18 are added and determined to be patentable.

*8. The hanger of claim 1, wherein the downturned lip constitutes a distal end of the lower jaw, said downturned lip being positioned relative to the elongate strip and the upstanding lip to provide a sufficient, uninterrupted space between the downturned lip and the wall when the elongate strip is attached to the wall and the downturned lip is disposed behind the upwardly-facing edge of the upstanding lip for accommodating a free edge of the flexible sheet material between the jaws and about the upwardly facing edge of the upstanding lip with the downturned lip disposed behind the upwardly-facing edge of the upstanding lip.*

*9. A combination of a hanger and a flexible sheet material anchored thereby, said hanger comprising an extrusion embodying a flat, elongate strip of generally rectangular configuration for engagement with a wall to which the flexible sheet material is to be attached, said strip having spaced, parallel, longitudinal edges and flat front and back faces, upper and lower vertically-spaced, forwardly-projecting jaws at the front face of the strip, said upper jaw being relatively fixed and having an upstanding lip spaced from and parallel to said strip defining an upwardly-facing edge, said lower jaw extending forwardly and upwardly from said front face toward the upper jaw and having a downturned lip defining a downwardly-facing edge spaced forwardly and downwardly from the upwardly-facing edge of the upstanding lip, said lower jaw being elastically displaced about an axis parallel to the upper jaw to dispose the downwardly-facing edge of the downwardly-extending lip behind the upwardly-facing edge of the upwardly-extending lip with a free edge of the flexible sheet material disposed between the jaws and about the upwardly-facing edge of the upper jaw to thus support the sheet material in suspension from the hanger.*

*10. The combination of claim 9 wherein the upper jaw of the hanger projects forwardly from the front face of the strip at substantially right angles thereto and the upstanding lip stands upwardly from a forward edge of the upper jaw at right angles thereto.*

*11. The combination of claim 9 wherein the lips of the hanger are embraced with each other with the free edge of the flexible sheet material disposed therebetween.*

*12. The combination of claim 9 wherein the strip of the hanger has along its upper longitudinal edge an embossed line of weakness which enables removing a portion of the strip of predetermined width from the upper edge of the strip.*

*13. The combination of claim 9 wherein the lower jaw comprises a portion extending forwardly and upwardly from the face of the strip and a portion extending upwardly and away from the face of the strip such that the downwardly-facing edge of the lower jaw is spaced forwardly of the upwardly-facing edge of the upper jaw and wherein said lower jaw is elastically yieldable about spaced, parallel axes parallel to the face of the strip to dispose the downwardly-facing edge behind the upwardly-facing edge into interlocking engagement therewith and with the free edge of the flexible sheet material.*

*14. A hanger for attaching an edge of a flexible sheet material to a wall to form a wall covering with said flexible sheet material, said hanger, in an as formed condition, comprising an extrusion embodying a flat, elongate strip of generally rectangular configuration for engagement with the wall, said strip having spaced, parallel, longitudinal edges and flat front and back faces, upper and lower vertically-spaced, forwardly-projecting jaws at the front face of the strip, and upper jaw being relatively fixed and having an upstanding lip spaced from and parallel to said strip defining an upwardly-facing edge, said lower jaw extending forwardly and upwardly from said front face toward the upper jaw, said lower jaw having a downturned lip, said downturned lip having an upper end spaced forwardly and upwardly from the upwardly-facing edge of the upstanding lip and a lower end defining a downwardly-facing edge spaced forwardly and downwardly from the upwardly-facing edge of the upstanding lip, said lower jaw being elastically displaceable about an axis parallel to the upper jaw to dispose the downwardly-facing edge of the downwardly-extending lip behind the upwardly-facing edge of the upwardly-extending lip to anchor the edge of the flexible sheet material disposed about the upwardly-facing edge of the upper jaw between the jaws to thus support the sheet material in suspension to form the wall covering.*

*15. A hanger according to claim 14 wherein the upstanding upper jaw projects forwardly from the front face of the strip at substantially right angles thereto and the lip stands upwardly from a forward edge of the upper jaw at right angles thereto.*

*16. A hanger according to claim 14 wherein the lips are structured to embrace each other when the downwardly-extending lip is positioned behind the upwardly-facing edge of the upwardly-extending lip.*

*17. A hanger according to claim 14 wherein the strip has along its upper longitudinal edge an embossed line of weakness which enables removing a portion of the strip of predetermined width from the upper edge of the strip.*

*18. A hanger according to claim 14 wherein the lower jaw comprises a portion extending forwardly and upwardly from the face of the strip and a portion extending upwardly and away from the face of the strip such that the downwardly-facing edge of the lower jaw is spaced forwardly of the upwardly-facing edge of the upper jaw and wherein said lower jaw is elastically yieldable about spaced, parallel axes parallel to the face of the strip to dispose the downwardly-facing edge behind the upwardly-facing edge into interlocking engagement therewith.*

* * * * *